US005588877A

United States Patent [19]

Davis et al.

[11] Patent Number: 5,588,877

[45] Date of Patent: Dec. 31, 1996

[54] ELECTRICAL CONNECTOR WITH MULTIPLE BLADE CONTACTS

[75] Inventors: Wayne S. Davis, Harrisburg; Michael E. Shirk, Grantville; Robert N. Whiteman, Jr., Harrisburg, all of Pa.

[73] Assignee: The Whitaker Corporation, Wilmington, Del.

[21] Appl. No.: 361,608

[22] Filed: Dec. 22, 1994

[51] Int. Cl.[6] ..... H01R 17/00

[52] U.S. Cl. ..... 439/660; 439/744

[58] Field of Search ..... 439/444, 744, 439/660, 595, 871, 872, 873

[56] References Cited

U.S. PATENT DOCUMENTS 4,174,880 11/1979 Hawkins et al. .
4,390,231 6/1983 Plyler et al. .
4,558,917 12/1985 Kamono et al. ..... 439/660 X
4,610,497 9/1986 Tsuchida et al. ..... 439/660
4,632,492 12/1986 Yamada ..... 439/660 X
4,734,060 3/1988 Kawawada et al. ..... 439/660
4,740,173 4/1988 Justiano et al. ..... 439/351
4,767,345 8/1988 Gutter et al. ..... 439/660 X
4,984,992 1/1991 Beamenderfer et al. ..... 439/108
5,092,790 3/1992 Justiano et al. ..... 439/351
5,207,603 5/1993 Peloza ..... 439/884

*Primary Examiner*—Khiem Nguyen
*Attorney, Agent, or Firm*—Anton P. Ness

[57] ABSTRACT

An electrical connector (1) having, an insulating housing (2), an elongated plug receiving single cavity (4) in a mating front (6) of the housing (2), and conductive multiple contacts (3) in the housing (2), the contacts (3) being spaced apart without insulation therebetween, the contacts (3) bridging across the single cavity (4) to opposite sides (5) of the single cavity (4), and the contacts (3) being latched to each opposite side (5) of the single cavity (4).

10 Claims, 4 Drawing Sheets

ELECTRICAL CONNECTOR WITH MULTIPLE BLADE CONTACTS

FIELD OF THE INVENTION

The invention relates to an electrical connector with multiple electrical contacts, and more particularly, to an electrical connector with multiple blade contacts in an insulating housing.

According to U.S. Pat. No. 5,092,790, multiple spring contacts are connected to respective wires, and are separated by respective channels in an insulating porcelain body.

According to U.S. Pat. No. 4,984,992, multiple electrical contacts are connected to respective wires. The contacts are constructed as flat metal plates. Locking lances extend from lateral edges of the contacts. Interior insulating walls on the housing insulate the multiple contacts from one another in the housing.

The prior connectors disclosed by the patents referred to above, are constructed with channels or interior walls separating multiple contacts in a housing. The channels or interior walls provide insulation for the contacts, and have been utilized to hold the contacts at a mating front of the connector in desired alignment for mating engagement with another mating electrical connector. The presence of the insulation reduces a target area on the contacts available to receive connection of another mating connector. The target area on the contacts would be advantageously enlarged by eliminating the insulation provided by the channels or interior walls.

The size of the connector can be reduced advantageously, if the channels or interior walls at the mating front of the housing can be eliminated. In a connector without interior walls or channels receiving the contacts, the contacts must be separated from one another, and be attached to the housing without reliance on interior walls or channels.

A problem to be solved by the invention is to provide an electrical connector with multiple contacts that are spaced apart within a mating front of an insulating housing without insulation therebetween.

According to a feature of an embodiment of the invention, electrical contacts in an insulating housing are spaced apart without insulation therebetween, and the contacts bridge across a cavity in a mating front of the housing and are attached to opposite sides of the cavity.

According to an embodiment of the invention, an electrical connector comprises an insulating housing and conductive multiple contacts in the housing; the contacts are spaced apart without insulation therebetween; the contacts bridge across a single cavity in the housing to opposite sides of the single cavity; and the contacts are latched to each opposite side of the single cavity.

An embodiment of the invention will now be described by way of example with reference to the accompanying drawings, according to which:

DETAILED DESCRIPTION

Figure 1:
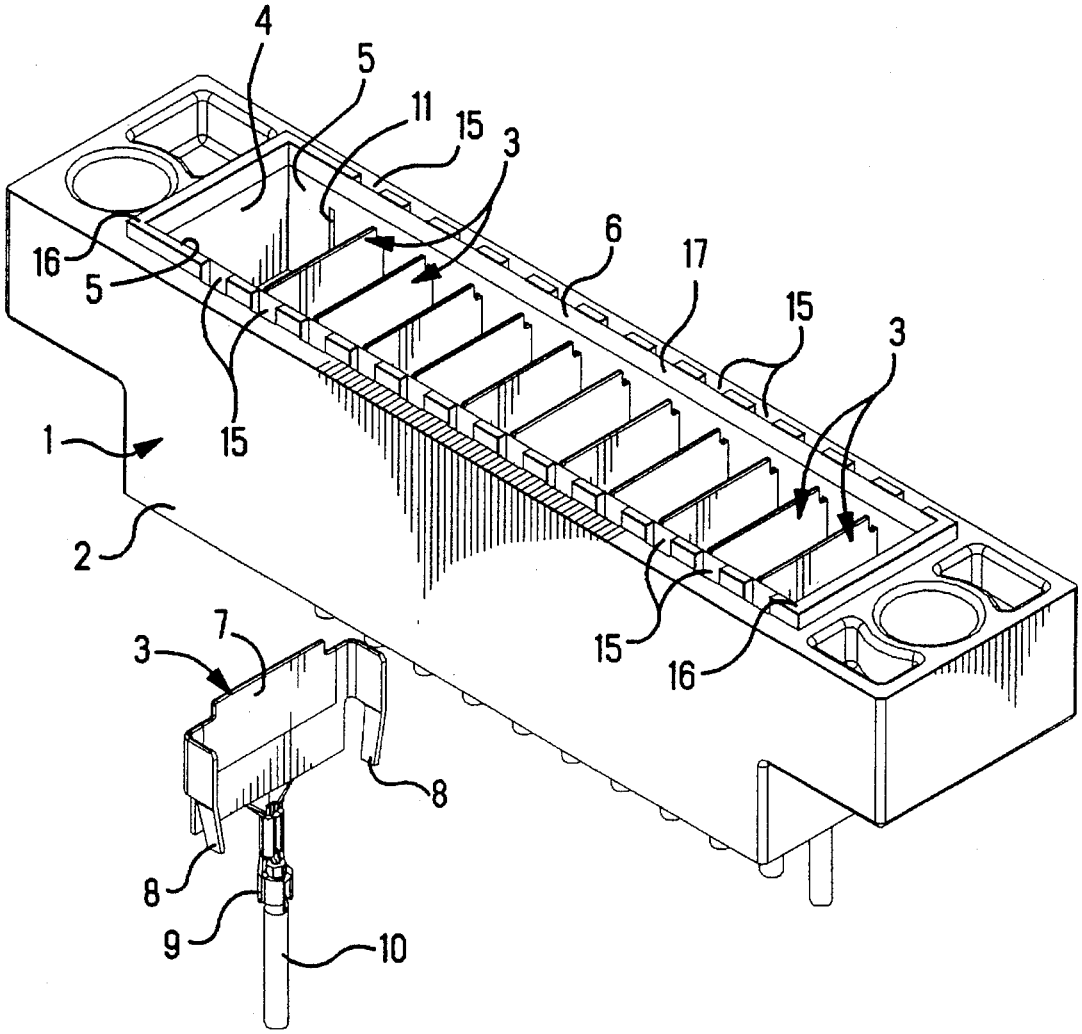
FIG. 1 is an isometric view of an electrical connector, with parts separated from one another.

With reference to FIG. 1, an electrical connector 1 comprises a unitary insulating housing 2 and conductive multiple contacts 3 in the housing 2; the contacts 3 are spaced apart without insulation therebetween; the contacts 3 bridge across a single cavity 4 in the housing 2 to opposite sides 5 of the single cavity 4; and the contacts 3 are latched to each opposite side 5 of the single cavity 4. The cavity 4 comprises an elongated plug receiving single cavity in a mating front 6 of the housing 2. The single cavity 4 is defined between opposed side walls and end walls and is without interior walls or channels providing insulation for separating the contacts 3 from one another within the single cavity 4.

Figure 5:
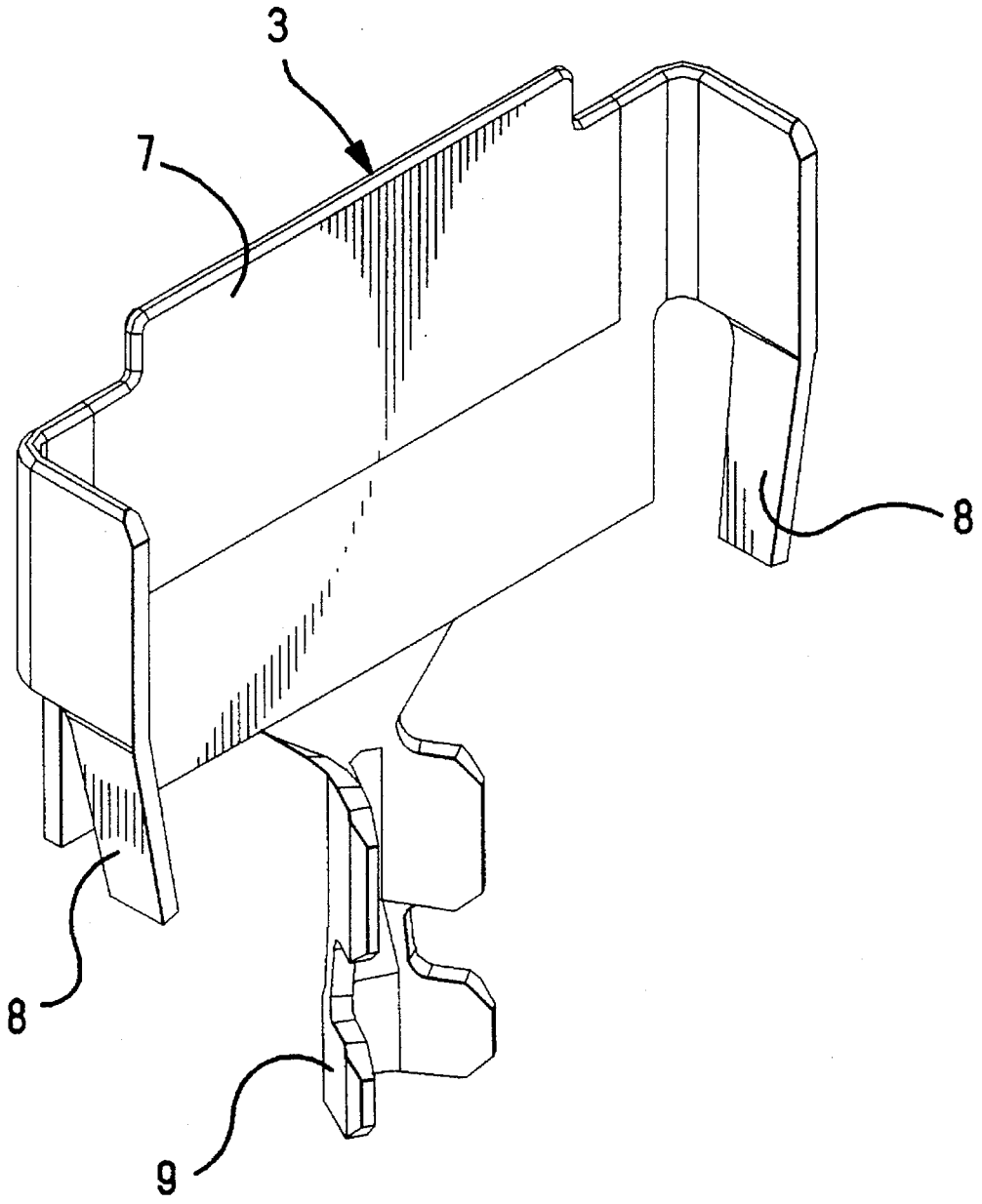
FIG. 5 is an enlarged isometric view of an electrical contact of the connector shown in FIG. 1.

With reference to FIG. 5, each of the contacts 3 is of unitary construction, stamped and formed from a thin metal plate and comprises an elongated width blade 7 with a leading end portion providing a wide target area, and projecting narrow lances 8 on opposite sides of the blade 7. Each of the blades 7 is a single thickness. The blade 7 extends from an edge of the plate. The lances 8 extend from respective side edge portions of opposed side portions of the plate, and are bent to project out of a thickness plane of the blade 7 at respective angles. The side edge portions are shown extending orthogonally to the plate. A wire connecting terminal 9 projects from an edge of the plate, and is formed into a barrel shape to encircle and connect to an insulated wire 10, FIG. 1.

Figure 2:
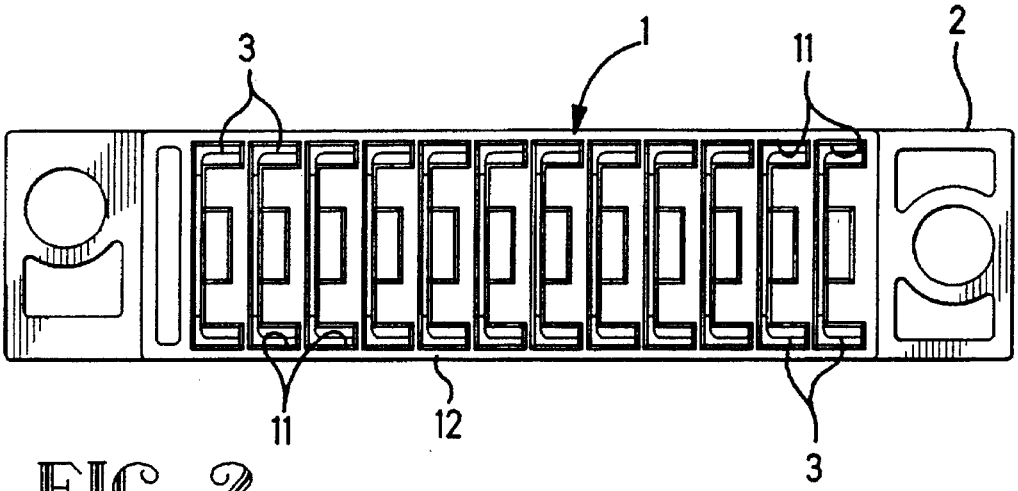
FIG. 2 is a bottom view of the connector shown in FIG. 1.
Figure 3:
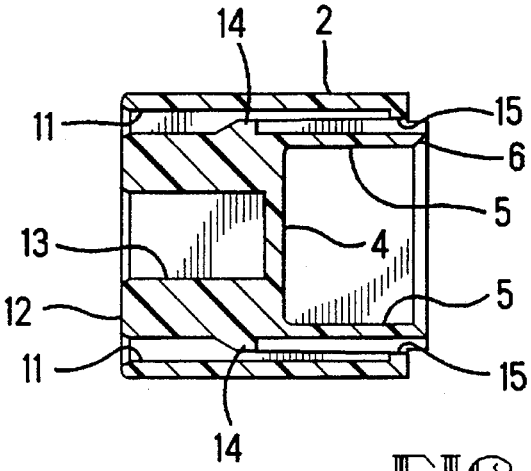
FIG. 3 is a section view of a housing of the connector shown in FIG. 2.
Figure 4:
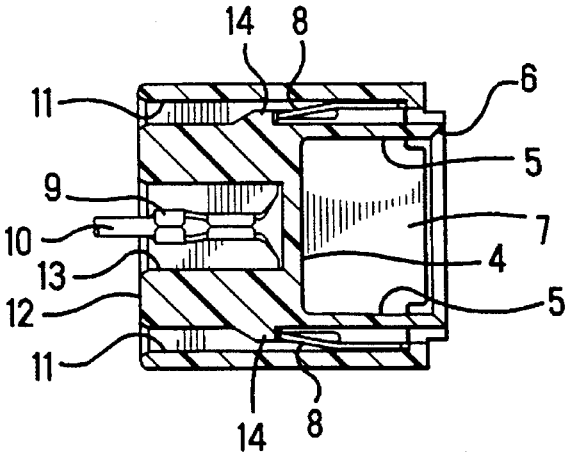
FIG. 4 is a view similar to FIG. 3 with a contact in the housing.

With reference to FIGS. 2 through 4, multiple, narrow, contact receiving slots 11 extend through a rear exterior wall 12 on a bottom of the housing 2 defining an insertion face. The wall 12 closes a bottom of the single cavity 4. Each rear facing slot 11 is shown to comprise a transverse slot portion and slot portions orthogonal thereto corresponding to side edge portions of respective blades 7, thus being shaped to encircle and receive the leading edge portion of a corresponding contact 3 during contact insertion. A rear facing, closed bottom recess 13 in the wall 12 communicates with each slot 11 and receives a corresponding terminal 9 therein. With reference to FIGS. 1 through 4, each of the opposite sides 5 of the single cavity 4 comprises the narrow slots 11 receiving respective blades 7. Each of the contacts 3 comprises the blade 7 bridging across the single cavity 4 and projecting in respective narrow slots 11 in opposite sides 5 of the single cavity 4. Unitary with the housing 2 are projecting latches 14, FIGS. 3 and 4, in the angled portions of the slots 11, and latching respective lances 8 in respective slots 11. The lances 8 traverse along the slots 11 and are resiliently deflected to pass beyond the latches 14. Once past the latches 14, the lances 8 resiliently deflect to oppose the forwardly facing latch surfaces of latches 14 and resist removal of the contacts 3 in a rearward direction.

Closed front ends of the slots 11 are rearward of the mating front 6 of the housing 2. Narrow core pin passages 15 extend from the mating front 6 and into the slots 11. The core pin passages 15 intercept respective latches 14 during a molding process to form the latches 14 in the interiors of the angled portions of the slots 11 and thus define the forwardly facing latch surfaces thereof. The mating front 6 of the housing 2 is on a projecting bezel 16 unitary with the housing 2. The bezel has a flared lip 17 behind the mating front 6. The passages 15 extend through the bezel 16.

Figure 6:
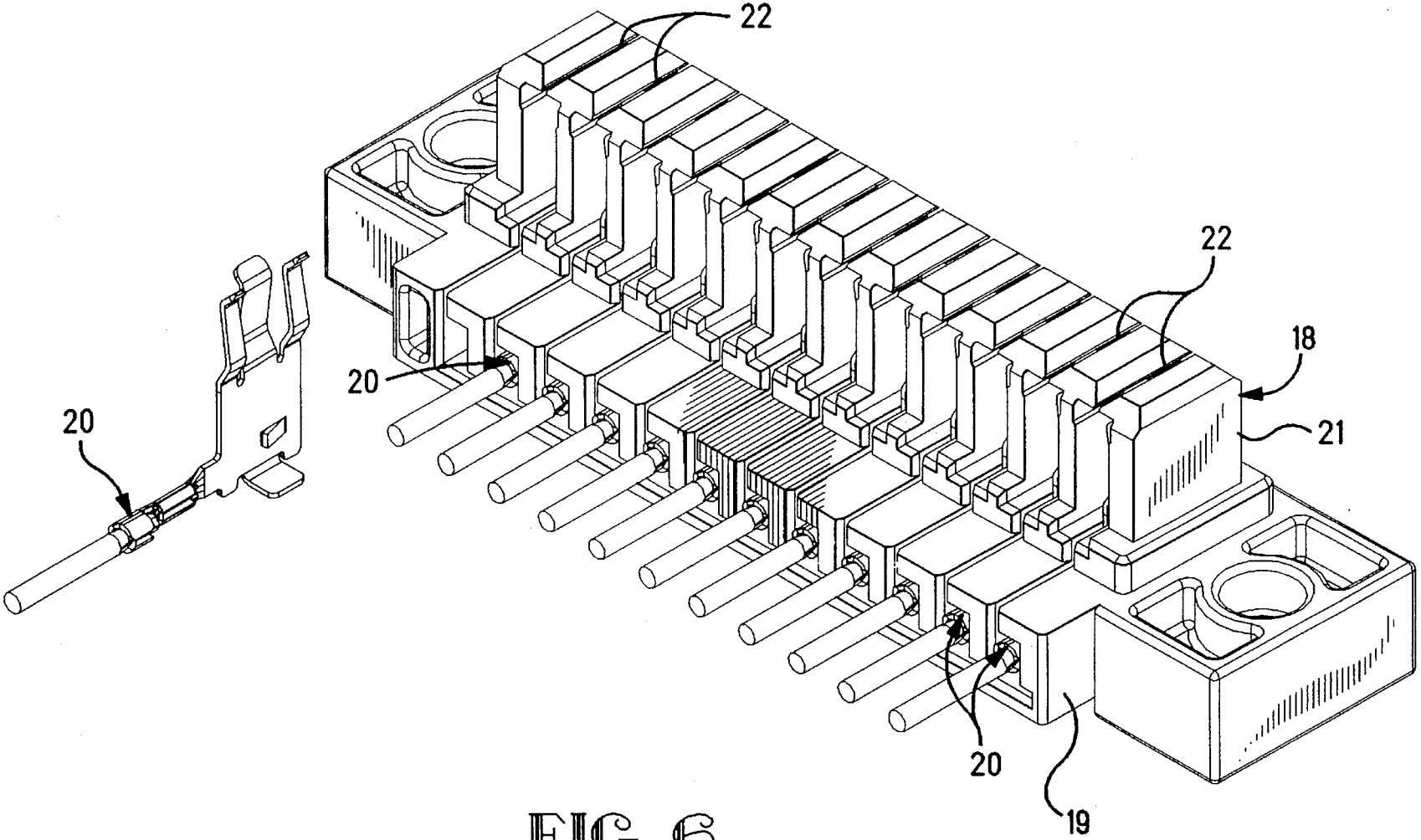
FIG. 6 is an isometric view of a mating electrical connector with parts separated from one another.

With reference to FIG. 6, a mating electrical connector 18 comprises a unitary insulating housing 19 and multiple electrical contacts 20 in the housing 19. The single cavity 4 and the multiple contacts 3 are adapted to receive a single insulative plug 21 on the mating electrical connector 18. The plug 21 is a single block and is mated to the connector 1 by insertion of the plug 21 into the cavity 4, and by receipt of narrow blade receiving slots 22 extending transversely across and in the plug 21 over the wide target area of respective blades 7 of the contacts 3. The blades 7 frictionally engage the mating contacts 20.

Other embodiments and modifications of the invention are intended to be covered by the spirit and scope of the appended claims.

We claim:

1. An electrical connector comprising an insulating housing, an elongated plug receiving single cavity in a mating front of the housing defined between opposed side and end walls, and conductive multiple contacts in the housing, the contacts being spaced apart without insulation therebetween adjacent the mating front, leading portions of the contacts bridging across the single cavity to opposite sides of the single cavity upon insertion into said housing from an insertion face opposed to said mating front, and opposed side portions of Said contact leading portions extend to opposed side edge portions through transverse slots in said cavity side walls extending to closed front ends adjacent said mating front, said side edge portions having resilient lances latched forwardly of latching surfaces defined in walls of said slots facing and remote from said mating front of said housing along opposite sides of said single cavity whereby said contacts are latchingly retained within said housing.

2. An electrical connector as recited in claim 1 wherein each of the contacts comprises a blade bridging across the single cavity.

3. An electrical connector as recited in claim 1 wherein core pin passages extend from the mating front of the housing and into the slots, and the core pin passages are aligned with respective latches.

4. An electrical connector as recited in claim 2 wherein each of the blades is a single thickness and the lances on each blade are bent to extend at the respective angles.

5. An electrical connector as recited in claim 1 wherein each of the contacts comprises a blade and projecting narrow lances on opposite sides of the blade project at respective angles with respect to the blade, and each of the opposite sides of the single cavity comprises slots receiving respective blades, and angled portions of the slots project at the same respective angles as the lances to receive the lances therein, and latches in the angled portions of the slots, the lances being latched against respective latches.

6. An electrical connector as recited in claim 5 wherein core pin passages extend from the mating front of the housing and into the slots, and the core pin passages are aligned with respective latches.

7. An electrical connector as recited in claim 1 wherein the mating front of the housing comprises a raised bezel encircling the single cavity.

8. An electrical connector as recited in claim 1 wherein the single cavity and the multiple contacts are adapted to receive a single insulative plug on a mating electrical connector, and the multiple contacts are adapted to be separated from one another by the single insulative plug.

9. An electrical connector as recited in claim 1 wherein said side edge portions coextend orthogonally from said side portions and are disposed in corresponding slot portions in communication with and orthogonal to said transverse slots.

10. An electrical connector as recited in claim 9 wherein said lances extend at angles from said side edge portions, and said corresponding slot portions define said latching surfaces.

* * * * *